United States Patent [19]

Neudorfer

[11] Patent Number: 4,596,241

[45] Date of Patent: Jun. 24, 1986

[54] BATHTUB CHAIR WITH BACK AND NECK MASSAGER

[76] Inventor: Jehuda Neudorfer, 600 Westluke Ave., Cote St. Luc, Quebec H4X 1P7, Canada

[21] Appl. No.: 565,234

[22] Filed: Dec. 27, 1983

[51] Int. Cl.[4] ..... A61H 7/00

[52] U.S. Cl. ..... 128/62 R; 128/33

[58] Field of Search ..... 128/62 R, 33, 44; 4/559, 578, 606; 297/16, 35, 39, 40

[56] References Cited

U.S. PATENT DOCUMENTS

| | | | |
|---|---|---|---|
| 663,969 | 12/1900 | Johnston et al. | 128/62 R |
| 1,537,464 | 5/1925 | Hummel, Jr. | 128/62 R |
| 1,929,107 | 10/1933 | Weaver | 128/33 |
| 2,168,975 | 8/1939 | Clarke | 128/62 R |
| 3,078,843 | 2/1963 | Brisson | 128/62 R |

FOREIGN PATENT DOCUMENTS

| | | | |
|---|---|---|---|
| 693774 | 7/1953 | United Kingdom | 297/39 |

*Primary Examiner*—Robert Peshock
*Assistant Examiner*—Cary E. Stone
*Attorney, Agent, or Firm*—Swabey, Mitchell, Houle, Marcoux & Sher

[57] ABSTRACT

A massaging assembly includes a massaging arrangement mounted on a seating arrangement which has a seat and back support. Two longitudinally extending parallel arms extend on either side of the seat, and the arms are pivotally supported. Handles are disposed at the ends of the arms remote from the back support and a massaging brush is disposed between and pivotally supported by the other ends of the arms. The assembly can be folded into a compact arrangement.

9 Claims, 3 Drawing Figures

BATHTUB CHAIR WITH BACK AND NECK MASSAGER

BACKGROUND OF INVENTION (a) Field of the Invention

The invention relates to a massaging assembly for massaging the back and neck of the user. More specifically, the invention relates to such an assembly which includes a massaging arrangement mounted on a seating arrangement, the assembly being foldable for shipping and carrying.

(b) Description of Prior Art

It is known in the art to provide bathtub attachments for, for example, applying soap to the back and the like. Such attachments are illustrated in U.S. Pat. No. 159,556, Woolsey, Feb. 9, 1875, U.S. Pat. No. 398,514, Kitchen, Feb. 26, 1889, U.S. Pat. No. 1,297,980, Weinberger, Mar. 18, 1919, and U.S. Pat. No. 1,488,076, Tebo, Mar. 25, 1924. However, all of these arrangements are mounted on or in some other way attachable to the bathtub so that they are not easily movable from one place to another.

U.S. Pat. No. 3,290,090, Ford, Dec. 6, 1966, illustrates a bath chair. Although the bath chair does make it more comfortable to sit in a bathtub, the bath chair of Ford does not include any massaging means.

U.S. Pat. No. 663,969, Johnston et al, Dec. 18, 1900, illustrates a massaging chair. However, this chair would not be easily adaptable for use in a bathtub. In any case, the chair of Johnston et al is not foldable so that a user would have difficulties moving it from one place to another.

U.S. Pat. No. 1,537,464, Hummel, Jr., May 12, 1925, teaches an arrangement for applying ointment to the back of the user. Once again, this arrangement would not be easily used in a bathtub, nor is this arrangement foldable.

SUMMARY OF INVENTION

It is therefore an object of the invention to provide a massaging assembly having a massaging arrangement mounted on a seat arrangement.

It is a more specific object of the invention to provide such an assembly which is foldable for ease of shipping and carrying.

In accordance with the invention there is provided a massaging assembly. The assembly includes a seating arrangement including a seat and a back support, and a massaging arrangement mounted on the seating arrangement. The massaging arrangement includes two longitudinally extending parallel arms, a respective arm extending on either side of the seat. A separate means on either side of the seat pivotally supports a respective one of the arms, and handle means are provided at the ends of the arms remote from the back support. Massaging means are disposed between and supported by the other ends of the arms. Thus, the user, seated in the assembly with his back adjacent to the back support, can grasp the handle and pivot the arms, whereby the massaging means will run up and down the back and neck of the user who is taking a bath at the same time.

BRIEF DESCRIPTION OF DRAWINGS

The invention will be better understood by an examination of the following description, together with the accompanying drawings, in which.

DESCRIPTION OF PREFERRED EMBODIMENTS

The massaging assembly includes a seating arrangement, illustrated generally at 1, and having a massaging arrangement, illustrated generally at 3, mounted on the seating arrangement. The massaging arrangement includes two longitudinally extending parallel arms 5 with upright portions 6. Disposed between the upright portions, and supported thereby, is a massaging means 7. The massaging means can comprise a massaging brush or sponge or massaging rollers, and preferably, the massaging means is removable for replacement. When a brush or sponge is used, the brush is mounted in a frame 8 whose back is open so that water can escape through the back.

Figure 1:
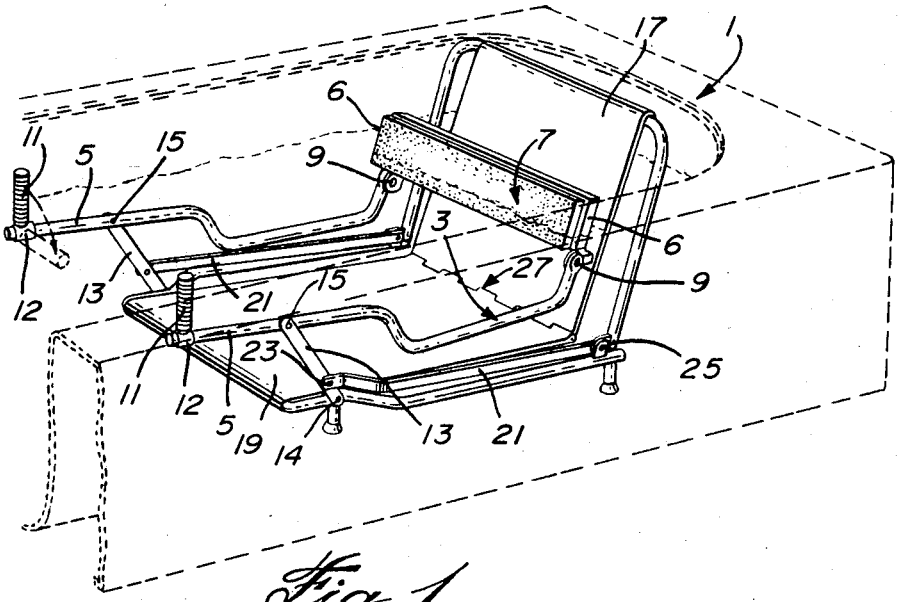
FIG. 1 is a perspective view of the assembly.
Figure 2:
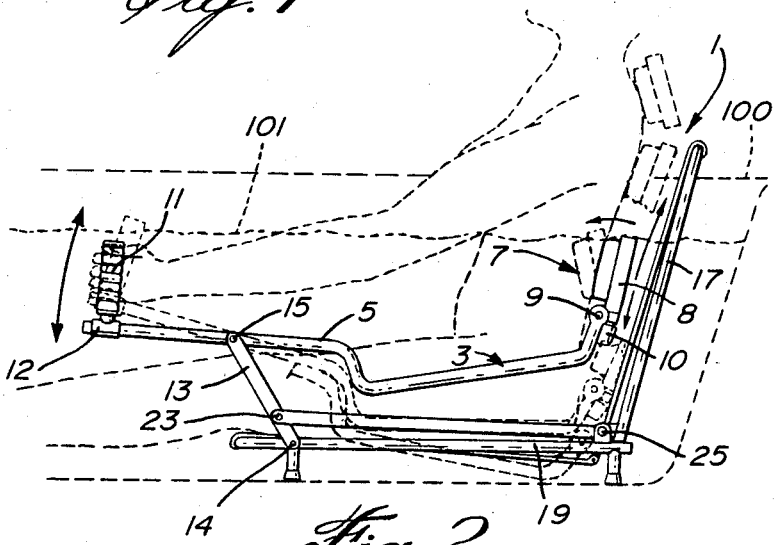
FIG. 2 is a side view of the assembly in its upright position and also shows the assembly in a bathtub and a user seated in the assembly.

The upright portions 6 are attached to the arms 5 by pivoting means 9. As seen in FIG. 2, a spring means 10 is provided in the pivoting means to urge the massaging means in the direction of the user U.

Figure 3:
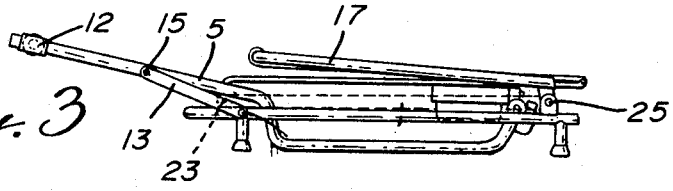
FIG. 3 is a side view of the assembly in its folded position.

Disposed at the end of the arms remote from the massaging means are handle means 11. Hinge means 12 permit the handle means to be folded inwardly as shown in FIG. 3.

Pivot arm support rods 13 are pivotally attached to arms 5 at 15 and are also pivotally attached to the seating arrangement at 14.

The seating arrangement includes a back support 17 and a seat 19. In the upright position, the back is at an angle of somewhat more than 90° to the seat. Support rods 21, on either side of seat 19, support a respective one of the pivot arm support rods 15 when the arrangement is in its upright position. Each support rod is pivotally connected to a respective one of pivot arm support rods 15 at 23 and on a respective side of the seating arrangement at 25. Hinges 27 permit the back support 17 to be folded relative to the seat 19.

In operation, the assembly works as follows:

The assembly is placed in a bathtub 100, as shown in FIG. 2, and the tub is filled with water 101 to preference. A user then seats himself in the seating arrangement, is also shown in FIG. 2, and grasps the handles 11 and moves them in a circular-like motion about the center 15. Accordingly, the arms 5 will pivot up and down to thereby move the massaging means 7 downwardly and upwardly. Because the arms 5 are disposed outside of the frame, they can be moved below the frame so that the massaging means will reach all the way down to the lower back. The massaging means will also reach up to the neck of the user.

Because of the urging of the spring 10, positive pressure will be applied on the back and neck of the user even as the massaging means changes position.

In order to fold the assembly, the two pivot arm support rods 13 are moved forwardly to the position illustrated in FIG. 3. The massaging means is folded forwardly so that it is parallel to the seat 19 as also illustrated in FIG. 3, and the back support is also folded forwardly on its hinges so that it overlies the folded up massaging means and is somewhat parallel to the seat.

The handles 11 are folded inwardly so that the entire assembly presents a compact arrangement.

Preferably the assembly is made of light-weight metal and plastic. For example, the frame of the seating arrangement can be made of a light-weight metal while the back support and the seat would be plastic. In the same way, the elements of the massaging arrangement will be made of a light-weight metal.

Alternatively, the entire arrangement can be made of a sturdy but light-weight plastic.

Although a particular assembly has been described, this was for the purpose of illustrating, but not limiting, the invention. Various modifications, which will come readily to the mind of one skilled in the art, are within the scope of the invention as defined in the appended claims.

I claim:

1. A massaging assembly, comprising:

(A) a seating arrangement including a seat and a back support;

(B) a massaging arrangement mounted on said seating arrangement and including:

(i) two longitudinally extending parallel arms, a respective arm extending on either side of said seat;

(ii) a separate means on either side of said seat for pivotally supporting a respective one of said arms;

(iii) handle means at the ends of said arms remote from said back support; and (iv) massaging means, disposed between, and supported by, the other ends of said arms, said massaging means being pivotally supported between the other ends of said arms;

whereby, when a user, seated in said assembly with his back adjacent to said back support, grasps the handle and pivots the arms, the massaging means will run up and down the back and neck of the user;

said seat being joined to said back support by a hinge, whereby said assembly is foldable by pivoting said arm support rods forwardly and folding said massaging means forwardly and downwardly so that it is somewhat parallel to said seat, and by folding said back support so that it overlies said massaging means and is somewhat parallel to said seat.

2. An assembly as defined in claim 1 wherein each said arm includes an upright portion at the end thereof remote from said handle means;

each upright portion being connected to its respective arms by a pivot means;

spring means in said pivot means of said upright portion for urging said massaging means in the direction of said user;

whereby, said massaging means will apply a positive force to the back and neck of a user.

3. An assembly as defined in claim 2 wherein said arms are pivotally supported by arm support rods extending upwardly on either side of said seat, said arm support rods being pivotally connected to a respective one of said arms and to a respective side of said seat.

4. An assembly as defined in claim 3 and including further support rods extending from a respective one of said arm support rods to a respective side of the bottom of said back support, said further support rods being pivotally attached at both ends thereof.

5. An assembly as defined in claim 4 wherein said massaging means are removable.

6. An assembly as defined in claim 5 wherein said massaging means comprises removable brushes.

7. An assembly as defined in claim 5 wherein said massaging means comprises removable rollers.

8. An assembly as defined in claim 5, wherein said massaging means comprises removable sponges.

9. An assembly as defined in claim 1 wherein said handle means are hingedly attached to a respective one of said arms to fold inwardly; whereby, said handle means will be folded inwardly when the assembly is folded to thereby provide a compact arrangement.

* * * * *